US007144005B2

(12) United States Patent
Sato et al.

(10) Patent No.: US 7,144,005 B2
(45) Date of Patent: Dec. 5, 2006

(54) CLAMPING DEVICE

(75) Inventors: Toshio Sato, Tsukuba-gun (JP); Akira Tadano, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 217 days.

(21) Appl. No.: 10/751,504

(22) Filed: Jan. 6, 2004

(65) Prior Publication Data

US 2004/0135302 A1 Jul. 15, 2004

(30) Foreign Application Priority Data

Jan. 15, 2003 (JP) ..... 2003-007353

(51) Int. Cl.
*B25B 1/06* (2006.01)

(52) U.S. Cl. ..... 269/226; 269/221; 269/224; 269/216

(58) Field of Classification Search ..... 269/220, 269/221, 222, 228, 32, 216, 226
See application file for complete search history.

(56) References Cited

U.S. PATENT DOCUMENTS 4,635,911 A * 1/1987 Lovrenich ..... 269/93

* cited by examiner

*Primary Examiner*—Robert C. Watson
(74) *Attorney, Agent, or Firm*—Oblon, Spivak, McClelland, Maier & Neustadt, P.C.

(57) ABSTRACT

A clamping device in which there is no need to carry out troublesome setting operation of a clamping position according to a size of a workpiece and wear of respective components and an operation efficiency can be further improved. A worm which is engaged with a worm wheel provided to a periphery of a rotating shaft of a clamping arm and which is connected to an electric motor can reciprocate in an axial direction. On the axis, a clamping force applying mechanism to be actuated in response to contact of the rotated clamping arm with the workpiece to apply an axial force in a direction of the axis to the worm is provided. The clamping arm is rotated by driving the worm for rotation by the electric motor and the clamping force applying mechanism applies a clamping force to the clamping arm which has come in contact with the workpiece.

14 Claims, 8 Drawing Sheets

CLAMPING DEVICE

TECHNICAL FIELD

The present invention relates to a clamping device for clamping a workpiece for a purpose of processing and the like.

BACKGROUND ART

In an automatic assembly line or the like in the automobile industry, a clamping device for clamping a workpiece for a purpose of processing is used frequently. As such a clamping device, there are already known devices as disclosed in Japanese Patent Application Laid-open No. 2001-105332, Japanese Patent Application Laid-open No. 2001-310225, Japanese Patent Application Laid-open No. 2001-009741, and the like, for example.

In each of these clamping devices, a toggle linkage for transmitting a driving force from a driving source to a clamping arm is disposed between the driving source and the clamping arm to thereby rotate and move the clamping arm to a predetermined clamping position which has been set in advance and then generate a large clamping force for clamping.

In the above clamping device, a position where the workpiece is clamped by the clamping, i.e., a position where the clamping force is to be generated in the clamping arm has to be set in advance by adjusting the clamping device according to a size of the workpiece. In case of a midcourse change in the size of the workpiece, because it is impossible to immediately adapt to the change, the clamping device needs to be stopped temporarily to reset the clamping position. Moreover, when respective members forming the above toggle linkage and the like wear as a result of repetition of operation, the clamping position is displaced and the workpiece cannot be clamped accurately. Therefore, the clamping device needs to be readjusted periodically to reset the clamping position.

As described above, in the conventionally-known clamping device, the above-described troublesome setting operation of the clamping position is required so as to accurately clamp the workpiece in the clamping position by the clamping arm and therefore operation efficiency is decreased.

PROBLEM TO BE SOLVED BY THE INVENTION

It is a technical object of the present invention to provide a clamping device in which the above problem is solved, there is no need to carry out troublesome setting operation of a clamping position according to a size of a workpiece and wear of respective components, and an operation efficiency can be further improved.

METHOD TO ACHIEVE THE OBJECT

To achieve the above objects, according to the present invention, there is provided a clamping device for clamping a workpiece between a clamping arm and an opposed clamping member by rotating the clamping arm supported for rotating on a body and applying a clamping force to the clamping arm, the device comprising: a worm to be driven for rotation about an axis on the body; a worm wheel provided to a periphery of a rotating shaft of the clamping arm and engaged with the worm; and a clamping force applying mechanism to be actuated in response to contact of the clamping arm with the workpiece supported by the clamping member to apply an axial force in a direction of the axis to the worm rotation of which has been stopped by the contact, wherein the clamping arm is rotated by driving of the worm for rotation and the axial force applied to the worm by the clamping force applying mechanism acts on the worm wheel as a pressing force in a direction of a tangent to the worm wheel to apply the clamping force to the clamping arm.

To put it more concretely, the worm is provided for reciprocation between an initial position and a clamping force transmitting position on the axis and the clamping force applying mechanism applies the axial force toward the initial position to the worm which has been displaced from the initial position to the clamping force transmitting position by a reaction force from the worm wheel generated by a clamping operation of the clamping arm.

As described above, with the clamping device according to the invention, the clamping force applying mechanism is actuated in response to contact of the rotated clamping arm with the workpiece to apply the axial force in the direction of the axis to the worm rotation of which has been stopped by the contact of the clamping arm and the axial force acts on the worm wheel as the pressing force in the direction of the tangent to the worm wheel, i.e., as torque about the rotating shaft of the clamping arm to thereby apply the clamping force which is a force for pressing the workpiece toward the clamping member to the clamping arm. Therefore, there is no need to carry out troublesome setting operation of the clamping position according to the size of the workpiece and wear of the respective components, the workpiece can be clamped accurately with the clamping arm, and the operation efficiency can be further improved.

In the clamping device, it is preferable that the worm is elastically supported toward the initial position by a support spring disposed on the same axis and formed of a disc spring, for example, and that the worm is displaced from the initial position to the clamping force transmitting position against the support spring by the reaction force from the worm wheel generated by the clamping operation of the clamping arm.

It is preferable that the clamping force applying mechanism includes a spring member disposed on the axis and applies a spring force of the spring member to the worm as the axial force. Especially, it is preferable that the spring member is the disc spring, that a "flexure-spring force" characteristic curve of the disc spring includes a region in which the spring force is substantially constant with respect to flexure variation, and that the spring force in this region is applied to the worm as the axial force. By utilizing the spring force of the disc spring in this region in which the spring force is substantially constant, it is possible to apply the stable clamping force to the clamping arm even if the workpiece W is slightly deformed by application of the clamping force, for example.

According to a preferred aspect of the clamping device of the invention, the device further comprises: a driving shaft supported for rotation about the axis and for sliding in a reciprocating manner in the direction of the axis on the body; one driving source for applying a driving force about the axis and a driving force in the direction of the axis to the driving shaft; and a driving force switching mechanism disposed between the driving source and the driving shaft to switch the driving force to be transmitted to the driving shaft from the driving source from the driving force about the axis to the driving force in the direction of the axis in response to the contact of the clamping arm with the workpiece, wherein the worm is provided to a periphery of the driving shaft, the driving force switching mechanism transmits the driving force about the axis to the driving shaft to drive the worm for rotation with the driving shaft in rotation of the clamping arm, a power train including the driving source, the driving shaft, and the driving force switching mechanism forms the clamping force applying mechanism in response to the contact of the clamping arm with the workpiece, and the driving force switching mechanism transmits the driving force in the direction of the axis to the driving shaft rotation of which has been stopped by the contact of the clamping arm to thereby apply the axial force to the worm.

To put it more concretely, the driving force switching mechanism is formed of a flange portion fixedly provided to the periphery of the driving shaft and formed with a first friction face on an end face of the flange portion and a gear which is formed on an outer periphery to which the driving force from the driving source is transmitted, and a gear formed with a second friction face to be brought in contact with and separated from the first friction face on an end face of the gear the gear nut is screwed over the driving shaft with the second friction face facing the first friction face and is supported for rotation about the axis on the body the driving force switching mechanism brings the first friction face of the flange portion and the second friction face of the gear nut in contact with each other to transmit the driving force about the axis to the driving shaft in rotation of the clamping arm, and the driving force switching mechanism screw-feeds the driving shaft rotation of which has been stopped by the contact of the clamping arm in the direction of the axis with the gear nut in response to the contact of the clamping arm with the workpiece to thereby separate the first friction face from the second friction face and transmit the driving force in the direction of the axis to the driving shaft.

On the other hand, the worm is fitted over the driving shaft for sliding in a reciprocating manner between an initial position and a clamping force transmitting position in the direction of the axis and is fixed about the axis to be displaced from the initial position to the clamping force transmitting position by a reaction force from the worm wheel generated by a clamping operation of the clamping arm and the driving shaft is provided with an engaging portion for pressing the worm which has been displaced to the clamping force transmitting position toward the initial position with the driving force in the direction of the axis to apply the axial force to the worm.

At this time, it is preferable that the clamping force applying mechanism includes a spring member disposed between the worm and the engaging portion, that the spring member is compressed by the driving force in the direction of the axis and transmitted to the driving shaft, and that a spring force of the compressed spring member is applied to the worm as the axial force. Especially, it is preferable that the spring member is a disc spring, that a "flexure-spring force" characteristic curve of the disc spring includes a region in which the spring force is substantially constant with respect to flexure variation, and that the spring force in this region is applied to the worm as the axial force.

It is preferable that the worm is elastically supported toward the initial position by a support spring disposed between the engaging portion of the driving shaft and the worm and formed of a disc spring, for example, and that the worm is displaced from the initial position to the clamping force transmitting position against the support spring by the reaction force from the worm wheel due to the clamping operation of the clamping arm.

As the driving source, an electric motor is suitable.

According to another preferable aspect of the clamping device of the invention, the device further comprises: an arm rotating driving source for driving the worm for rotation; a clamping force generating driving source provided to the clamping force applying mechanism independently of the arm rotating driving source so as to actuate the clamping force applying mechanism; and a contact sensor for detecting the contact of the clamping arm with the workpiece to output a signal for causing the clamping force generating driving source to operate, wherein the clamping force generating driving source is caused to operate by the output signal from the contact sensor to actuate the clamping force applying mechanism to thereby apply the axial force to the worm.

To put it more concretely, the clamping device further comprises a driving shaft supported for rotation about the axis and for sliding in a reciprocating manner in the direction of the axis on the body and connected to the arm rotating driving source, wherein the worm is fixedly provided to a periphery of the driving shaft to be able to reciprocate between an initial position and a clamping force transmitting position on the axis and the clamping force applying mechanism applies the axial force toward the initial position to the worm which has been displaced from the initial position to the clamping force transmitting position by a reaction force from the worm wheel generated by a clamping operation of the clamping arm.

The clamping force applying mechanism includes the clamping force generating driving source, a spring member disposed on the axis, a plunger to be reciprocated in the direction of the axis by operation of the clamping force generating driving source, a sliding shaft passing through a center of the spring member and having one end fixed to the plunger and the other end formed with a shaft head portion with which one end of the spring member is in contact, and a spring seat with which the other end of the spring member is in contact and which supports the sliding shaft for sliding in the direction of the axis, the spring member being compressed between the shaft head portion and the spring seat by reciprocation of the plunger, wherein the clamping force generating driving source operates in response to the output signal from the contact sensor and, as a result, the shaft head portion presses the driving shaft in the direction of the axis with the spring force of the spring member compressed between the shaft head portion and the spring seat to thereby apply the spring force to the worm as the axial force.

Here, it is preferable that the spring member is a disc spring, that a "flexure-spring force" characteristic curve of the disc spring includes a region in which the spring force is substantially constant with respect to flexure variation, and that the spring force in this region is applied to the worm as the axial force.

According to another aspect of the clamping device of the invention, it is preferable that the worm is elastically supported toward the initial position by a support spring disposed on the same axis and formed of a disc spring, for example, and the worm is displaced from the initial position to the clamping force transmitting position against the support spring by the reaction force transmitted from the worm wheel due to the contact of the clamping arm with the workpiece.

At this time, it is preferable that the contact sensor is for sensing that the worm has been displaced to the clamping force transmitting position.

As the arm rotating driving source, an electric motor is suitable. As the clamping force generating driving source, an electromagnetic driving device utilizing an electromagnetic attracting force is suitable.

EMBODIMENTS OF THE INVENTION

FIGS. 1 to 8 show two embodiments of a clamping device according to the present invention.

Figure 1:
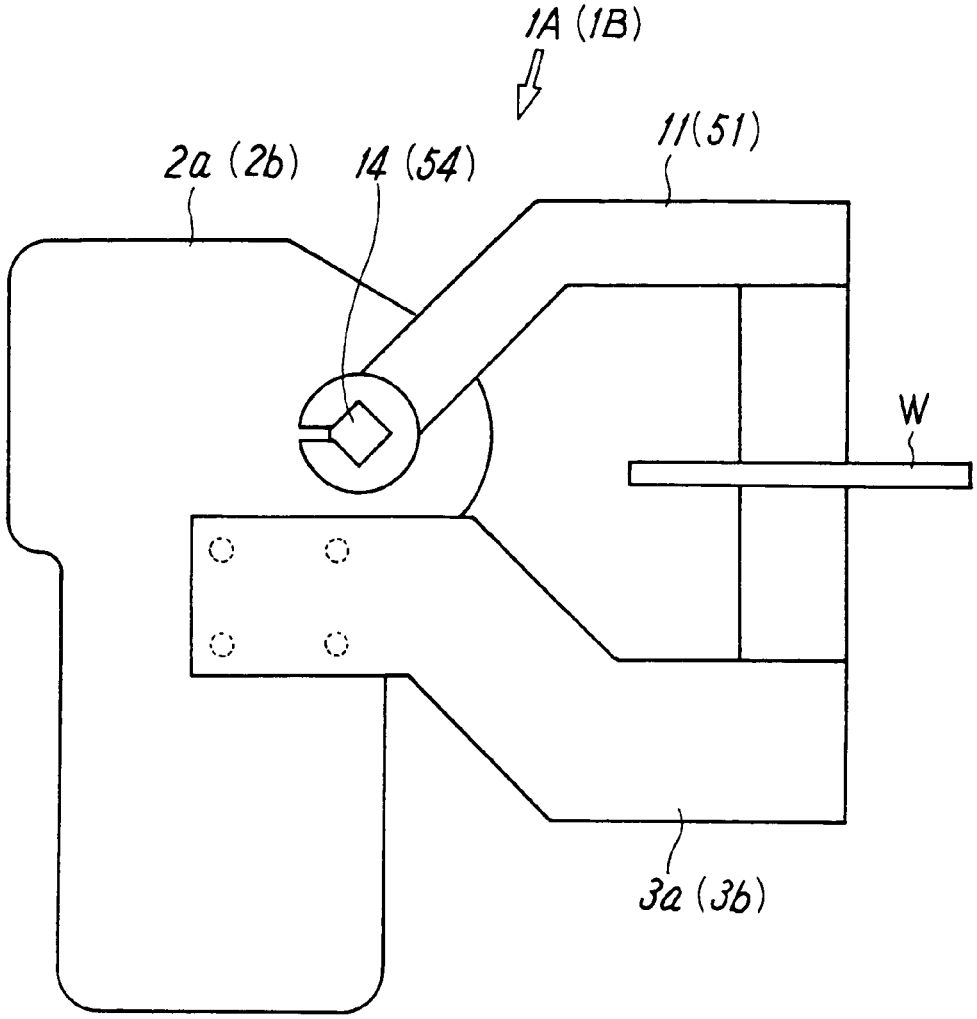
FIG. 1 is an external view of embodiments of a clamping device according to the present invention.

To give an outline of the embodiments according to the invention, the clamping device 1A (1B) is for clamping a workpiece W between a clamping arm 11 (51) and an opposed clamping member 3*a* (3*b*) fixed to a body 2*a* (2*b*) by rotating the clamping arm 11 (51) supported for rotating on the body 2*a* (2*b*) and applying a clamping force to the clamping arm 11 (51) as shown in FIG. 1.

Provided in the body 2*a* (2*b*) are an electric motor 40 (80) as a driving source, a worm 21 (61) connected to the electric motor 40 (80) to be driven for rotation about an axis 11 (12) on the body 2*a* (2*b*), a worm wheel 13 (53) fixedly provided to a periphery of a rotating shaft 12 (61) of the clamping arm 11 (51) and engaged with the worm 21 (61), and a clamping force applying mechanism to be actuated in response to contact of the clamping arm 11 (51) with the workpiece W to apply a force in a direction of the axis 11 (12), i.e., an axial force to the worm 21 (61) rotation of which has been stopped by contact of the clamping arm 11 (51).

Here, the clamping arm 11 (51) is detachably mounted to the rotating shaft 12 (52) supported for rotating on the body 2*a* (2*b*) and more concretely to a square shaft portion 14 (54) formed at an outer end of the rotating shaft 12 (52), rotates with the worm wheel 13 (53) and the rotating shaft 12 (52), and can be replaced if necessary.

Figure 3:
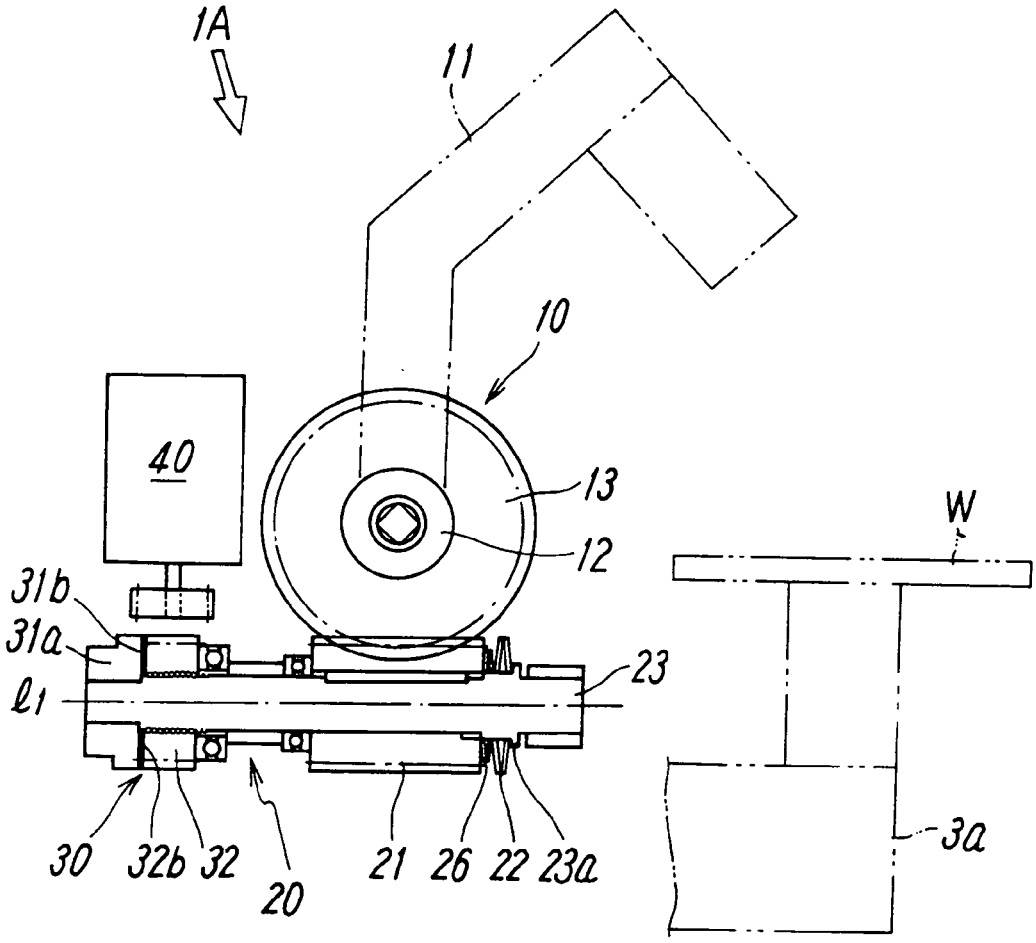
FIG. 3 is an operation explanatory view of a state in which the clamping arm is in a home position before rotating in the first embodiment.

By driving the worm 21 (61) for rotation by the electric motor 40 (80), a driving force is transmitted to the clamping arm 11 (51) through engagement of the worm 21 (61) and the worm wheel 13 (53) with each other and the clamping arm 11 (51) is rotated toward the clamping member 3*a* (3*b*) from a home position (see FIG. 3 (FIG. 6)) where the clamping arm 11 (51) is fully open.

Then, when the clamping arm 11 (51) comes in contact with the workpiece W supported by the clamping member 3*a* (3*b*), the clamping force applying mechanism is actuated in response to the contact and the axial force is applied to the worm 21 (61) rotation of which has been stopped by contact of the clamping arm 11 (51). Consequently, the axial force acts on the worm wheel 13 (53) which is engaged with the worm 21 (61) and rotation of which has similarly been stopped as a pressing force in a direction of a tangent to the worm wheel 13 (53), i.e., torque about the rotating shaft 12 (52). As a result, the clamping force, i.e., the force toward the clamping member 3*a* (3*b*) and pressing the workpiece W supported by the clamping member 3*a* (3*b*) is applied to the clamping arm 11 (51).

Figure 5:
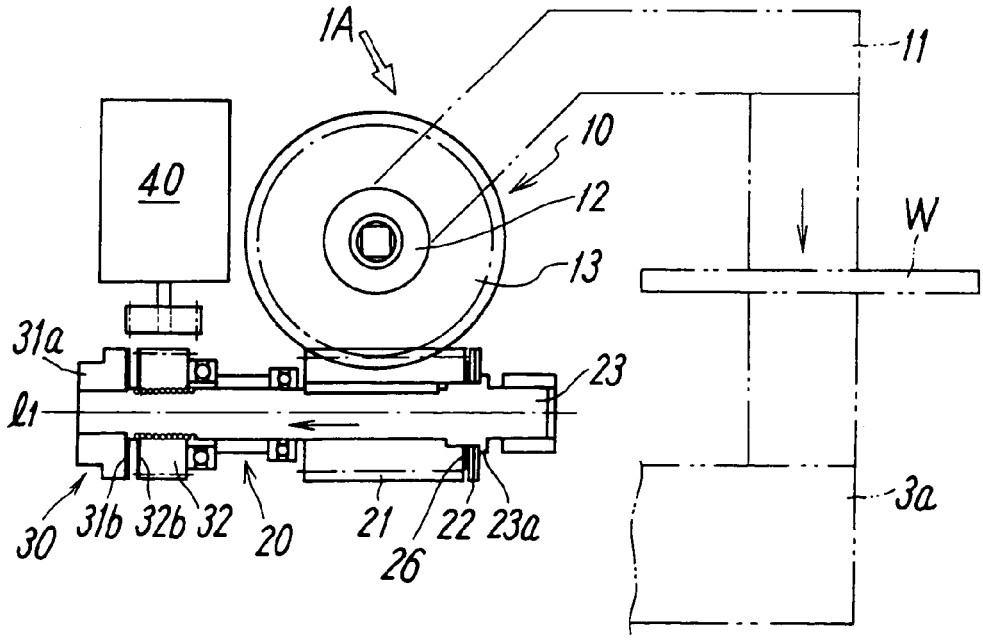
FIG. 5 is an operation explanatory view of a state in which the clamping arm is in contact with a workpiece and a clamping force is applied to the clamping arm in the first embodiment.

To put it more concretely, the worm 21 (61) is provided for reciprocation between an initial position (see FIG. 3 (FIG. 6)) occupied when the clamping arm 11 (51) is in the home position on the axis 11 (12) and a clamping force transmitting position (see FIG. 5 (FIG. 8)) occupied when the clamping force is applied to the clamping arm 11 (51). The worm 21 (61) is supported by being elastically pushed toward the initial position by a support spring 26 (66).

Thus, while being driven for rotation by the electric motor 40 (80), the worm 21 (61) is displaced from the initial position to the clamping force transmitting position against the support spring 26 (66) by a reaction force transmitted from the worm wheel 13 (53) as a result of clamping operation (rotating toward the clamping member 3*a* (3*b*) and/or contact with the workpiece W) of the clamping arm 11 (51) and the axial force toward the initial position (in a direction opposite to the reaction force) is applied by the clamping force applying mechanism in the clamping force transmitting position.

The clamping force applying mechanism includes a disc spring 22 (74) as a spring member disposed on the axis 11 (12) and a spring force of the compressed disc spring 22 (74) is applied as the axial force to the worm 21 (61) as a result of actuation of the clamping force applying mechanism.

Figure 9:
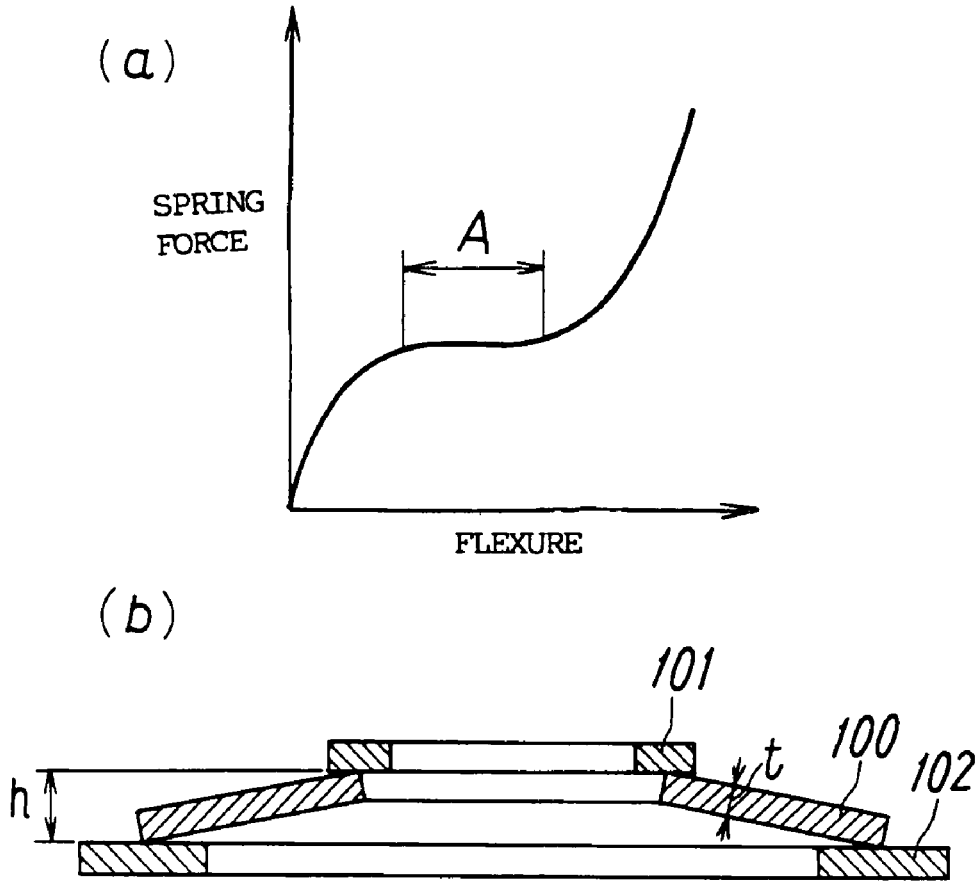
FIG. 9(*a*) is a diagram showing a characteristic of a disc spring used for a clamping force applying mechanism and FIG. 9(*b*) is a sectional view showing an example of a structure of the disc spring showing such a characteristic.

Here, the disc spring 22 (74) preferably has a region A in which the spring force is substantially constant and does not vary with respect to flexure variation in a "flexure-spring force" characteristic curve as shown in FIG. 9(*a*). By applying the spring force as the axial force to the worm 21 (61) in this region A, the clamping force can be kept substantially constant even if there are thickness differences between the workpieces W or if the workpiece is deformed to some degree due to application of the clamping force. The above characteristic curve can be obtained when a disc spring 100 is sandwiched between support plates 101 and 102 and a load is applied on the spring 100 as shown in FIG. 5(*b*), for example, and it is verified by an experiment that the region A can be obtained when a ratio between an effective height h and a plate thickness t of the disc spring 100 is about h/t=1.4. The load characteristic of the disc spring can be adjusted in a wide range in general not only by forming the spring on the above condition but also by combining a plurality of disc springs in parallel or series. Therefore, it is possible to properly select conditions on which the load is constant irrespective of the flexure.

On the other hand the support spring 26 (66) has such a degree of modulus of elasticity as to be compressed by the reaction force transmitted to the worm 21 (61) from the worm wheel 13 (53) as a result of clamping operation of the clamping arm 11 (51) and is preferably a disc spring.

Although only the clamping arm 11 (51) rotates and the clamping member 3*a* (3*b*) is fixed to the body 2*a* (2*b*) in the present embodiment, it is also possible that the clamping member 3*a* (3*b*) also rotates similarly or is driven linearly.

Next, the first embodiment of the clamping device according to the invention will be described concretely by using FIGS. 2 to 5. Detailed descriptions of the items which have been described in the outline of the embodiments will be omitted so as to avoid overlaps.

The clamping device 1A is formed of the electric motor 40 as the driving source, an arm portion 10 formed by mounting the clamping arm 11 to the rotating shaft 12 supported for rotating on the body 2*a* and providing the worm wheel 13 to a periphery of the rotating shaft 12, and an arm driving portion 20 which has the worm 21 engaged with the worm wheel 13 and is connected to the electric motor 40 to transmit the driving force of the electric motor 40 to the arm portion 10 through engagement of the worm 21 and the worm wheel 13 with each other. By rotating the clamping arm 11 by the driving force of the electric motor 40 and applying the clamping force to the clamping arm 11, the workpiece W is clamped between the clamping arm 11 and the opposed clamping member 3*a* fixed to the body 2*a*.

In addition to the worm 21, the arm driving portion 20 is formed of a driving shaft 23 which is supported for rotation about the axis 11 and for sliding in a reciprocating manner in the direction of the axis 11 on the body 2*a* and over which the worm 21 is fitted, a reduction gear mechanism 35 connected to the electric motor 40, and a driving force switching mechanism 30 disposed between the reduction gear mechanism 35 and the driving shaft 23 to transmit the driving force of the electric motor 40 to the driving shaft 23 as a driving force about the axis 11 or a driving force in the direction of the axis 11 by switchover.

Here, the worm 21 is fitted over the driving shaft 23 to be able to slide in a reciprocating manner in the direction of the axis 11 and to be fixed about the axis 11 by a sliding key 21*a* and an engaging portion 23*a* for pressing the worm 21 toward the initial position by the driving force in the direction of the axis 11 and transmitted by the driving force switching mechanism 30 to apply the axial force to the worm 21 is provided to a periphery of the driving shaft 23.

The driving force switching mechanism 30 has a function of switching the driving force transmitted to the driving shaft 23 from the electric motor 40 from the driving force about the axis 11 to the driving force in the direction of the axis 11 in response to contact of the clamping arm 11 with the workpiece W.

Figure 4:
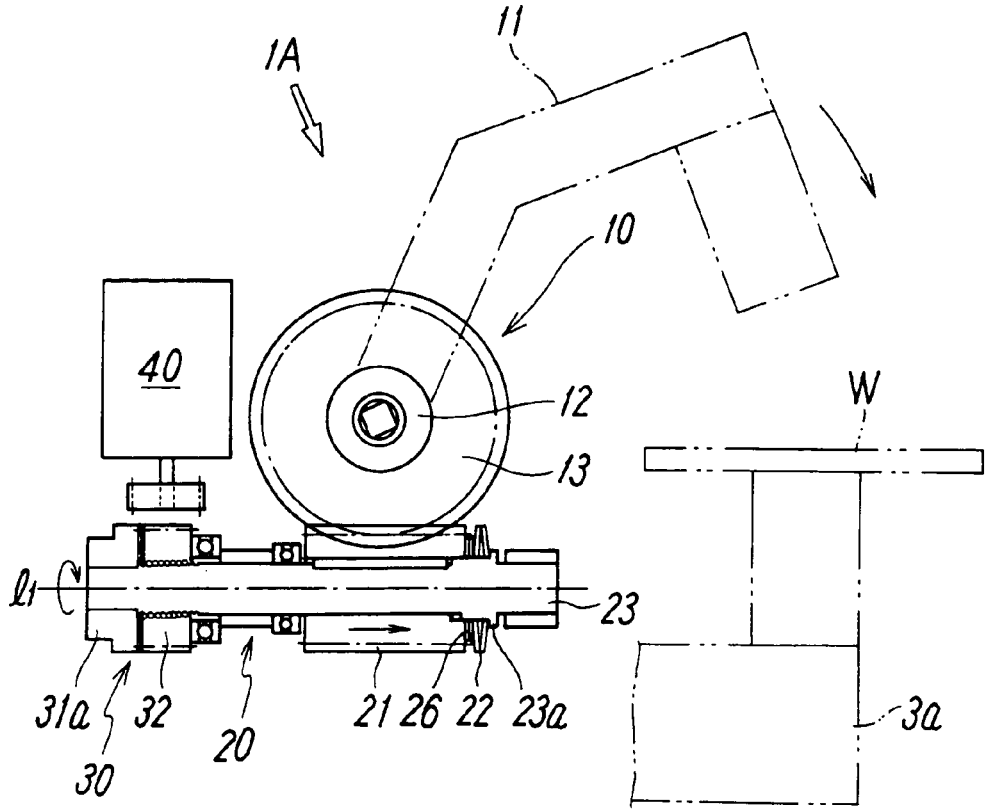
FIG. 4 is an operation explanatory view of a state in which the clamping arm is rotating in the first embodiment.

When the clamping arm 11 rotates, the driving force switching mechanism 30 transmits the driving force about the axis 11 to the driving shaft 23 to drive the driving shaft 23 for rotation with the worm 21 as shown in FIG. 4. Then, when the clamping arm 11 comes in contact with the workpiece W supported by the clamping member 3*a*, rotation of the worm 21, the worm wheel 13, and the driving shaft 23 is stopped as the clamping arm 11 stops as shown in FIG. 5. At the same time, by switchover of the driving force switching mechanism 30 in response to the contact of the clamping arm 11, a power train including the electric motor 40, the driving force switching mechanism 30, and the driving shaft 23 which has stopped rotating forms the clamping force applying mechanism and the driving force in the direction of the axis 11 is transmitted to the driving shaft 23. Consequently, the engaging portion 23*a* provided to the periphery of the driving shaft 23 presses the worm 21 which has similarly stopped rotating in the direction of the axis 11 and applies the axial force to the worm 21. As a result, the pressing force in the direction of the tangent acts on the worm wheel 13 engaged with the worm 21 and the clamping force is applied to the clamping arm 11 in contact with the workpiece W.

Figure 2:
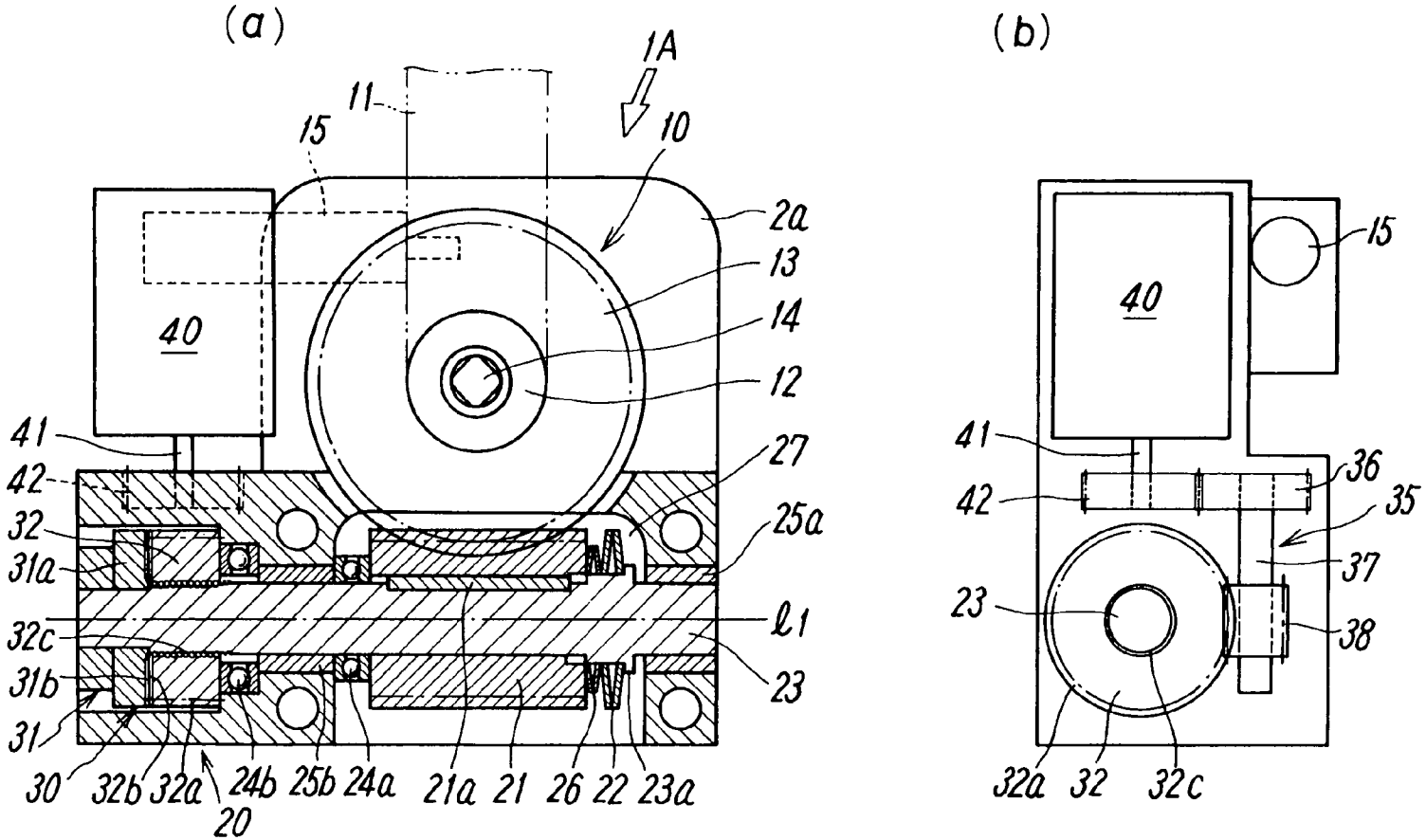
FIGS. 2(*a*) and 2(*b*) are sectional views of a power train of a clamping arm and show the first embodiment of the clamping device according to the invention.

To put it more concretely, as shown in FIG. 2(*a*), the driving force switching mechanism 30 and the engaging portion 23*a* are respectively disposed on opposite sides of the worm 21 on the driving shaft 23 and the worm 21 and the engaging portion 23*a* are housed in a hollow portion 27 formed in the body 2*a*. In the hollow portion 27, the disc spring 22 as the spring member forming the clamping force applying mechanism and the support spring 26 having a smaller modulus of elasticity than the disc spring 22 are disposed in series between the engaging portion 23*a* of the driving shaft 23 and an end face of the worm 21 with the support spring 26 disposed on a side of the worm 21, a rolling bearing 24*a* fixed to an inner face of the hollow portion 27 is disposed between the other end face of the worm 21 and the body 2*a*, and the worm 21 is elastically pushed by the support spring 26 to come in contact with the rolling bearing 24*a*. Furthermore, the driving shaft 23 is supported by sliding bearings 25*a*, 25*b* disposed at opposite ends of the hollow portion 27 to be able to rotate about the axis 11 and slide in the reciprocating manner in the direction of the axis 11 on the body 2*a*.

The support spring 26 has such a degree of modulus of elasticity as to be compressed by the reaction force transmitted from the worm wheel 13 to the worm 21 as a result of the clamping operation of the clamping arm 11 and is preferably a disc spring.

Then, while being driven for rotation with the driving shaft 23, the worm 21 slides over the driving shaft 23 in the direction of the axis 11 against the support spring 26 by the reaction force as a result of the clamping operation of the clamping arm 11 and is displaced from the initial position (see FIG. 3) where the worm 21 is in contact with the rolling bearing 24*a* to the clamping force transmitting position (see FIG. 5), i.e., toward the engaging portion 23*a* while compressing the support spring 26.

On the other hand, the driving shaft 23 is in an arm rotating position shown in FIGS. 3 and 4 when the clamping arm 11 rotates and the driving force about the axis 11 is transmitted to the driving shaft 23 by the driving force switching mechanism 30. Then, when the clamping arm 11 comes in contact with the workpiece W, the driving force switching mechanism 30 is switched in response to the contact and transmits the driving force to the driving shaft 23, the driving force being in the direction of the axis 11 and acting in such a direction (a direction opposite to the reaction force) as to move the engaging portion 23*a* close to the worm 21. Consequently, the driving shaft 23 is displaced from the arm rotating position to the clamping force applying position shown in FIG. 5 while compressing the disc spring 22 between the engaging portion 23*a* and the worm 21. As a result, the driving shaft 23 presses the worm 21 which has been displaced to the clamping force transmitting position toward the initial position (in the direction opposite to the reaction force) with the spring force of the compressed disc spring 22 to apply the spring force to the worm 21 as the axial force.

In this manner, the driving shaft 23 is supported for sliding in the reciprocating manner on the body 2*a* and reciprocates between the arm rotating position and the clamping force applying position on the axis 11 while the worm 21 is fitted for sliding in the reciprocating manner over the driving shaft 23 and similarly reciprocates between the initial position and the clamping force transmitting position on the axis 11.

The driving force switching mechanism 30 is formed of a flange portion 31*a* provided to a periphery of the driving shaft 23 by fixedly fitting a friction ring 31 over the driving shaft 23 and has a first friction face 31*b* on an end face on a side of the worm 21, and a gear nut 32 with cogs 32*a* which engage with the reduction gear mechanism 35 and to which the driving force from the electric motor 40 is transmitted formed at an outer periphery and a second friction face 32*b* to be brought into contact with and separated from the first friction face 31*b* formed at an end face of the gear nut 32.

Here, the gear nut 32 is a small worm wheel screwed over the driving shaft 23 by a screw 32*c* such as a ball screw and a sliding screw and is rotatably supported on the body 2*a* by a ball bearing 24*b* disposed on an opposite side to the second friction face.

The flange portion 31*a* may be formed integrally with the driving shaft.

In other words, when the clamping arm 11 rotates, the driving force switching mechanism 30 brings the first friction face 31*b* of the driving shaft 23 in the arm rotating position and the second friction face 32*b* of the gear nut 32 into contact with each other to transmit the driving force about the axis 11 to the driving shaft 23 to thereby drive the driving shaft 23 to rotate and actuate with the gear nut 32 in the arm rotating position.

Then, when the rotated clamping arm 11 comes in contact with the workpiece W, rotation of the worm 21 and the driving shaft 23 is stopped by the contact while the gear nut 32 is kept rotating by the electric motor 40. Therefore, the gear nut 32 transmits the driving force in the direction of the axis 11 and acting in the direction opposite to the reaction force to the driving shaft 23 by screw feeding and, as a result, the driving shaft 23 simultaneously separates the first friction face 31*b* from the second friction face 32*b* and is driven from the arm rotating position to the clamping force applying position while compressing the disc spring 22.

The reduction gear mechanism 35 is disposed between the electric motor 40 and the driving force switching mechanism 30 as shown in FIG. 2(*b*) to amplify the driving force of the electric motor 40 and to transmit it to the driving shaft 23 and is formed of a gear 36 engaged with a driving gear 42 of a motor shaft 41 in the electric motor 40, a small worm 38 engaged with the gear nut 32 which is the small worm wheel, and a gear shaft 37 for supporting the gear 36 and the small worm 38 for rotation on the body 2*a*.

The body 2*a* is provided with a shock absorber 15 for coming in contact with the clamping arm 11 to stop it cushioningly when the clamping arm 11 releases clamping of the workpiece W and is rotated in such a direction as to separate from the clamping member 3*a* to return to the home position.

Next, operation of the clamping device 1A will be described in detail based on FIGS. 3 to 5.

First, as shown in FIG. 3, when the clamping arm 11 is in the home position where it is fully open, the worm 21 is elastically pushed by the support spring 26 in the initial position and is in contact with the rolling bearing 24*a*, the driving shaft 23 is in the arm rotating position, and the first friction face 31*b* of the flange portion 31*a* provided to the periphery of the driving shaft 23 is in contact with the second friction face 32*b* of the gear nut 32 screwed over the driving shaft 23 and rotatably supported on the body 2*a*.

Then, when the electric motor 40 is started and rotated normally, the driving force of the electric motor 40 is transmitted as the driving force about the axis 11 to the driving shaft 23 as a result of the contact of the first friction face 31*b* of the driving shaft 23 and the second friction face 32*b* of the gear nut 32 with each other, the worm 21 and the worm wheel 13 engaged with the worm 21 are driven for rotation with the driving shaft 23, and the clamping arm 11 rotates from the home position toward the clamping member 3*a*, as shown in FIG. 4. At this time, the worm 21 separates from the rolling bearing 24*a* and is displaced from the initial position to the clamping force transmitting position on the driving shaft 23 while compressing the support spring 26 by the reaction force transmitted from the worm wheel 13 as the clamping arm 11 rotates.

Then, when the clamping arm 11 comes in contact with the workpiece W supported by the clamping member 3*a*, rotation of the worm wheel 13, the worm 21, and the driving shaft 23 is stopped by the contact as shown in FIG. 5. At this time, the worm 21 has fully compressed the support spring 26 and has reached the clamping force transmitting position. As a result, the driving shaft 23 which has stopped rotating is screw-fed in the opposite direction to the reaction force by the gear nut 32 which is kept rotating by the driving force of the electric motor 40. In other words, the driving force of the electric motor 40 is transmitted to the driving shaft 23 as the axial driving force acting in the opposite direction to the reaction force and the driving shaft 23 separates the first friction face 31*b* from the second friction face 32*b* and is displaced from the arm rotating position to the clamping force applying position while compressing the disc spring 22 between the engaging portion 23*a* and the end face of the worm 21. As a result, the driving shaft 23 presses the worm 21 which has been displaced to the clamping force transmitting position toward the initial position with the spring force of the compressed disc spring 22 and applies the spring force to the worm 21 as the axial force. Consequently, the pressing force in the direction of the tangent acts on the worm wheel 13 and the clamping force is applied to the clamping arm 11. After the clamping force has been applied to the clamping arm 11, it is preferable to stop the electric motor 40.

Furthermore, in order to release clamping of the workpiece W, by reversely rotating the electric motor 40 and reversing the above clamping procedure, the clamping arm 11 is released from the clamping force, rotated reversely in such a direction as to move away from the clamping member 3*a*, and returned to the home position. On the other hand, the worm 21 and the driving shaft 23 are returned respectively to the initial position and the arm rotating position simultaneously with the clamping arm 11.

As described above, with the clamping device 1A according to the first embodiment of the invention, the clamping arm 11 can be rotated and the clamping force can be applied to the clamping arm 11 by the one electric motor 40 without using a sensor for detecting the contact of the clamping arm 11 with the workpiece W. Therefore, it is possible to provide at low cost the clamping device in which there is no need to carry out troublesome setting operation of a clamping position according to a size of the workpiece W and wear of respective components and an operation efficiency can be further improved.

Next, a second embodiment of the clamping device according to the invention will be described concretely by using FIGS. 6 to 8. Detailed descriptions of the items which have been described in the outline of the embodiments and the first embodiment are omitted so as to avoid overlaps.

A clamping device 1B is formed of an arm portion 50 formed by mounting the clamping arm 51 to the rotating shaft 52 supported for rotating on the body 2*b* and providing the worm wheel 53 to a periphery of the rotating shaft 52, an arm rotating mechanism 60 including the worm 61 supported for rotation about the axis 12 on the body 2*b* and engaged with the worm wheel 53 and the electric motor 80 (driving source for rotating the arm) connected to the worm 61, a clamping force applying mechanism 70 which includes a clamping force generating driving source 75 independent of the electric motor 80 and applies an axial force in the direction of the axis 12 to the worm 61 by operation of the clamping force generating driving source 75, and a contact sensor 65 for detecting the contact of the clamping arm 51 with the workpiece W and outputting a signal for causing the clamping force generating driving source 75 to operate.

Then, the driving force of the electric motor 80 in the arm rotating mechanism 60 is transmitted to the arm portion 50 through the engagement of the worm 61 and the worm wheel 53 with each other and, as a result, the clamping arm 51 is rotated. Then, when the contact sensor 65 detects the contact of the rotated clamping arm 51 with the workpiece W, the clamping force applying mechanism 70 is actuated by operation of the clamping force generating driving source 75 to thereby apply the axial force to the worm 61. As a result, the axial force is transmitted to the arm portion 50 through the engagement of the worm 61 and the worm wheel 53 with each other to apply the clamping force to the clamping arm 51, the worm 61 and the worm wheel 53 having stopped rotating due to the contact of the clamping arm 51 with the workpiece W.

To the arm rotating mechanism 60, the worm 61 is fixedly provided at a periphery of the mechanism 60 in addition to the worm 61 and the electric motor 80. The arm rotating mechanism 60 is formed of a driving shaft 63 supported for rotation about the axis 12 and for sliding in a reciprocating manner in the direction of the axis 12 on the body 3*b* and a reduction gear mechanism 90 connected to the electric motor 80 to transmit the driving force of the electric motor 80 to the driving shaft 63 as a driving force about the axis 12. As the drive shaft 36 slides, the worm 61 and the driving shaft 63 integrally reciprocate between the initial position (see FIG. 6) and the clamping force transmitting position (see FIG. 8) on the axis 12.

Figure 7:
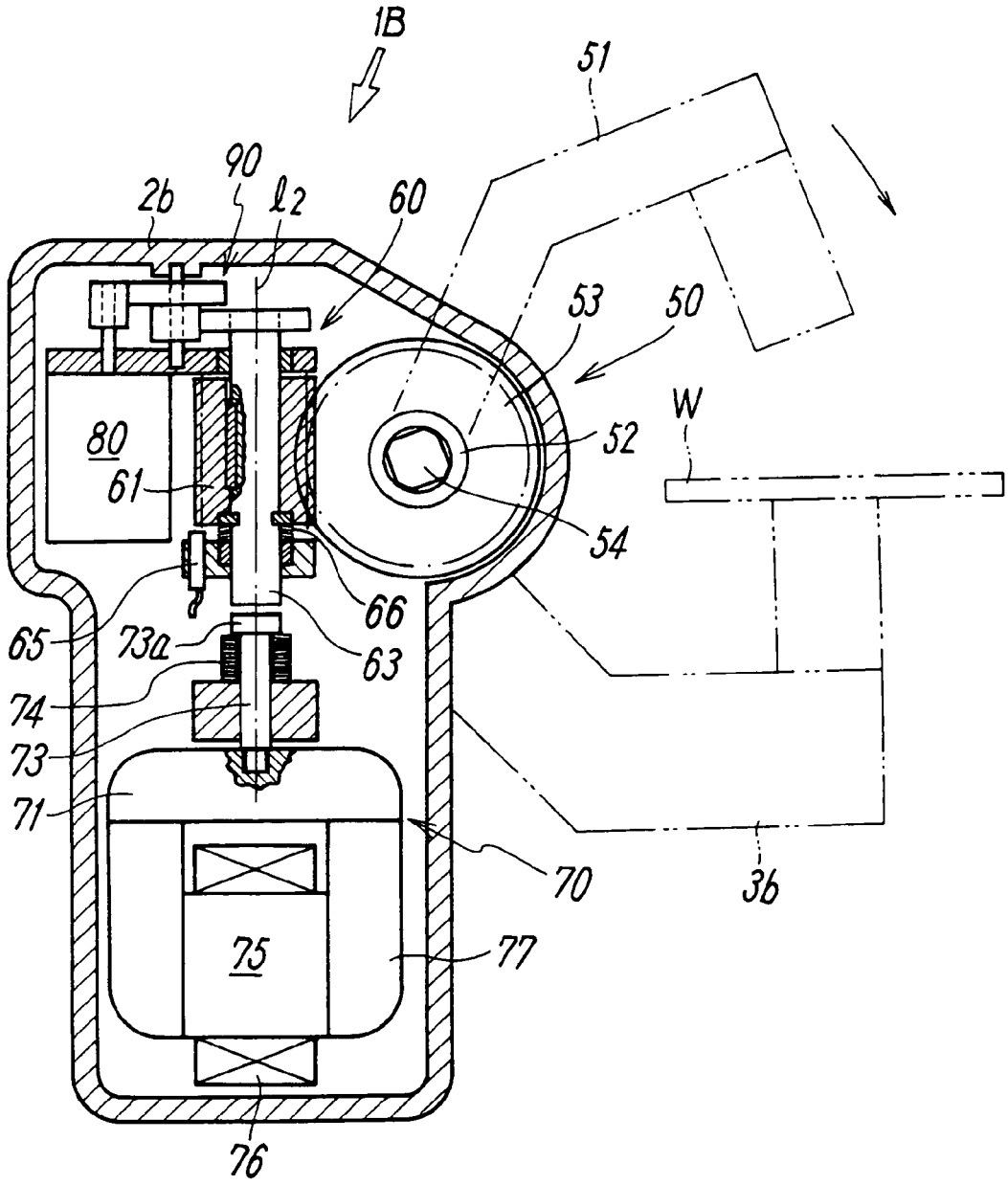
FIG. 7 is a sectional view of a state in which the clamping arm is rotating in the second embodiment.

In other words, when the clamping arm 51 rotates, the driving force of the electric motor 80 is transmitted to the driving shaft 63 in the arm turning mechanism 60 through the reduction gear mechanism 90 and the driving shaft 63 is driven for rotation with the worm 61 about the axis 12 as shown in FIG. 7. Then, when the clamping arm 51 comes in contact with the workpiece W supported by the clamping member 3*b* as shown in FIG. 8, the contact sensor 65 detects the contact to cause the clamping force generating driving source 75 to operate to thereby actuate the clamping force applying mechanism 70 as described above. On the other hand, at this time, the worm 61 and the driving shaft 63 have been displaced from the initial position to the clamping force transmitting position by the reaction force from the worm wheel 53 generated by the clamping operation of the clamping arm 51. The clamping force applying mechanism 70 applies the axial force toward the initial position (in the direction opposite to the reaction force) to the worm 61 and the driving shaft 63 which have been displaced to the clamping force applying position and which have stopped rotating due to the contact of the clamping arm 51. As a result, the axial force acts as the pressing force in the direction of the tangent on the worm wheel 53 engaged with the worm 61 and the clamping force is applied to the clamping arm 51 in contact with the workpiece W.

Although the worm 61 is fitted over the driving shaft 63 in a fixed manner about the axis 12 and in the direction of the axis 12 by means of a key 61*a* and the like, it is also possible that the worm 61 and the driving shaft 63 are formed integrally.

To put it more concretely, the driving shaft 63 is supported for rotation about the axis 12 and for sliding in the reciprocating manner in the direction of the axis 12 by sliding bearings 64*a*, 64*b* respectively provided to a first bearing frame 85 and a second bearing frame 86 on the body 2*b* on opposite sides of the worm 61 provided to a periphery of the driving shaft 63.

Between an end face of the worm 61 and an opposed face of the second bearing frame 86, the support spring 66 is provided to pass through the driving shaft 63 to support the worm 61 and the driving shaft 63 while elastically pushing them toward the initial position.

Here, the support spring 66 has such a degree of modulus of elasticity as to be compressed by the reaction force transmitted to the worm 61 from the worm wheel 53 as a result of the clamping operation of the clamping arm 51 and is preferably a disc spring.

The second bearing frame 86 is provided with a proximity sensor as the contact sensor 65 facing an end face of the worm 61 on a side of the support spring 66. The contact sensor 65 senses that the worm 61 has been displaced to the clamping force transmitting position with the driving shaft 63 against the spring force of the support spring 66 and has approached the second bearing frame 86 to thereby detect that the clamping arm 51 has come in contact with the workpiece W and outputs a signal for causing the clamping force generating driving source 75 to operate and a signal for stopping the electric motor 80.

However, if the contact sensor 65 senses that the worm 61 has been displaced to the clamping force transmitting position to thereby detect that the clamping arm 51 has come in contact with the workpiece W as described above, the support spring 66 needs to have such a degree of modulus of elasticity as not to be compressed by a reaction force transmitted to the worm 61 from the worm wheel 53 as a result of rotating of the clamping arm 51 and as to be compressed by a reaction force transmitted as a result of the contact of the clamping arm 51 with the workpiece W.

When the clamping arm 51 rotates toward the clamping member 3*b*, the support spring 66 elastically pushes and supports the worm 61 toward the initial position against the reaction force transmitted as a result of rotating of the clamping arm 51 to thereby retain the worm 61 substantially in the initial position as shown in FIG. 7. Then, when the rotated clamping arm 51 comes in contact with the workpiece W, the worm 51 compresses the support spring 66 against the spring force of the support spring 66 and is displaced to the clamping force transmitting position with the driving shaft 63 by the reaction force transmitted as a result of the contact as shown in FIG. 8.

The clamping force applying mechanism 70 further includes, in addition to the clamping force generating driving source 75, the disc spring 74 as the spring member disposed on an extension of the axis on a side (clamping force transmitting position side) on which the driving shaft 63 is supported by the second bearing frame 86, a plunger 71 to be reciprocated in the direction of the axis 12 by operation of the clamping force generating driving source 75, a sliding shaft 73 passing through a center of the disc spring 74 and having one end fixed to the plunger 71 and the other end formed with a shaft head portion 73*a* with which an end of the disc spring 74 is to be in contact, and a spring seat 72 which supports the sliding shaft 73 for sliding in a reciprocating manner in the direction of the axis 12 on the body 2*b* and with which the other end of the disc spring 74 is to be in contact.

In other words, the disc spring 74 is sandwiched between the shaft head portion 73*a* and the spring seat 72, the shaft head portion 73*a* of the sliding shaft 73 moves forward and backward with respect to the end face of the driving shaft 63 as a result of reciprocation of the plunger 71, and the disc spring 74 is expanded and compressed between the shaft head portion 73*a* and the spring seat 72.

The clamping force generating driving source 75 is an electromagnetic driving device utilizing an electromagnetic attracting force and concretely a solenoid 75 formed by winding a coil 76 about a U-shaped yoke 77. With the electromagnetic attracting force generated by energizing the coil 76, the plunger 71 is attracted to the yoke 77. At least a portion of the plunger 71 to be attracted to the yoke 77 is formed of a ferromagnetic material.

In the clamping device 1B of this second embodiment, when the clamping arm 51 rotates from the home position toward the clamping member 3*b*, the coil 76 of the solenoid 75 is energized and the plunger 71 is attracted to the yoke 77 to thereby move the shaft head portion 73*a* of the sliding shaft 73 backward from the end face of the driving shaft 63 and compress the disc spring 74 to build up the spring force (see FIG. 7). Then, by the reaction force caused by the contact of the clamping arm 51 with the workpiece W, the worm 61 and the driving shaft 63 are displaced to the clamping force transmitting position. When the end face of the driving shaft 63 comes in contact with or approaches the shaft head portion 73*a*, the contact sensor 65 de-energizes the coil 76 to thereby release attraction of the plunger 71 to the yoke 77. As a result, the shaft head portion 73*a* of the sliding shaft 73 pushes the end face of the driving shaft 63 toward the initial position (in the opposite direction to the reaction force) with the spring force of the compressed disc spring 74 and the spring force is applied to the worm 61 as the axial force (see FIG. 8).

The reduction gear mechanism 90 is for amplifying the driving force of the electric motor 80 supported by the first bearing frame 85 and for transmitting it to the driving shaft 63 and is formed of a first gear 91 engaged with a driving gear 82 of a motor shaft 81 in the electric motor 80, a second gear 92 engaged with a shaft gear 62 provided to the periphery of the driving shaft 63, and a gear shaft 93 supported between the body 2*b* and the first bearing frame 85 to support the first gear 91 and the second gear 92 for rotation. At least the shaft gear 62 and the second gear 92 engaged with the shaft gear 62 out of the above gears 62, 75, 76, 78, and 82 are preferably spur gears.

Next, operation of the clamping device 1B will be described in detail based on FIGS. 6 to 8.

Figure 6:
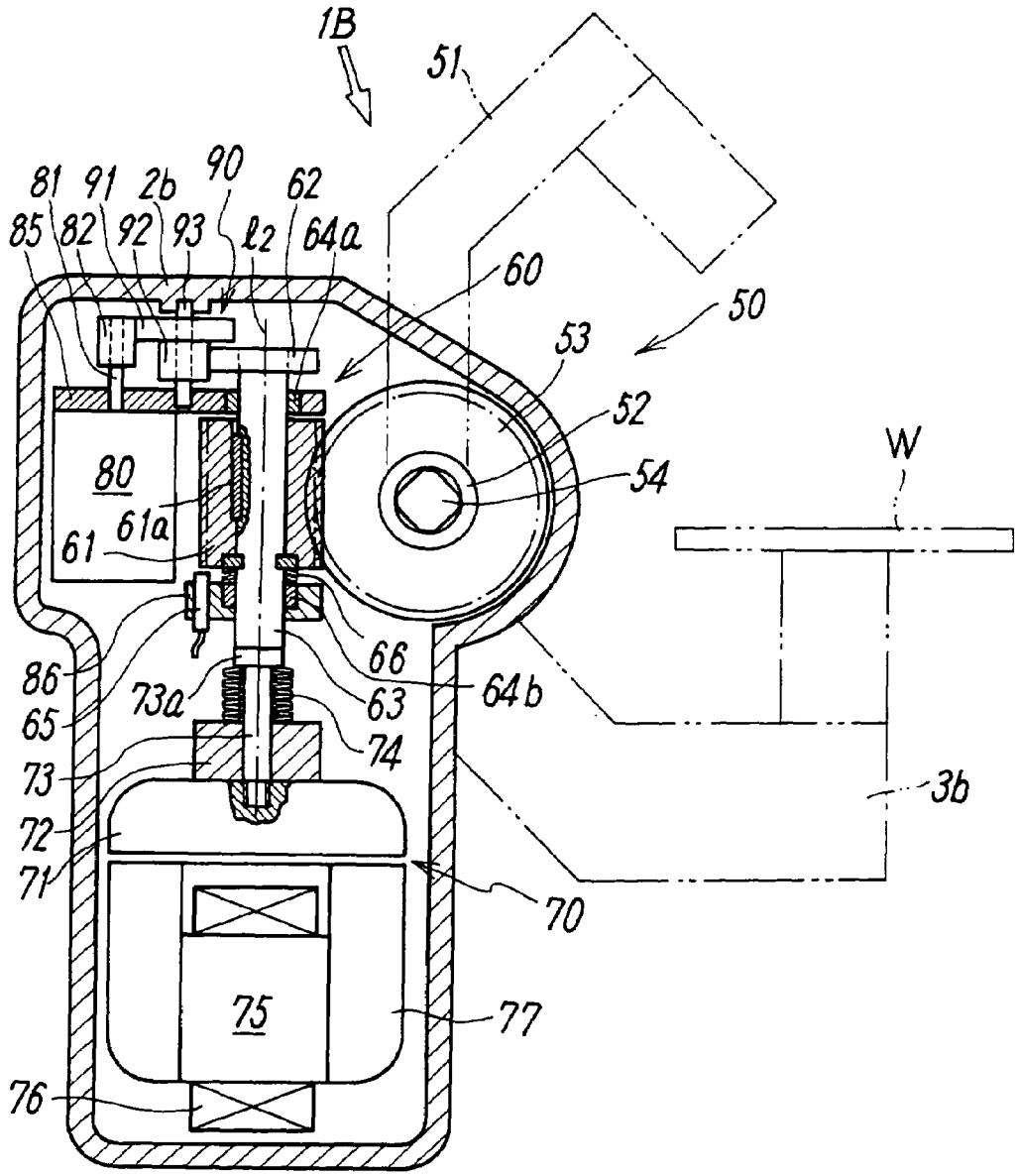
FIG. 6 shows the second embodiment of the clamping device according to the invention and is a sectional view of a state in which the clamping arm is in a home position before rotating.

First, as shown in FIG. 6, in a state in which the electric motor 80 is stopped, the solenoid 90 is de-energized, and the clamping arm 51 is in the home position, the worm 61 and the driving shaft 63 are in the initial position, the sliding shaft 73 is elastically pushed toward the driving shaft 63 by the disc spring 74, the plunger 71 is in contact with the spring seat 72, and the shaft head portion 73*a* of the sliding shaft 73 is in contact with or close to the end face of the driving shaft 63.

Then, as shown in FIG. 7, in order to rotate the clamping arm 51 from the home position toward the clamping member 3*b*, the electric motor 80 is started and rotated normally and the driving force of the electric motor 80 is transmitted as the driving force about the axis 12 through the reduction gear mechanism 90 to the driving shaft 63 to the periphery of which the worm 61 is provided to thereby drive the worm wheel 53 engaged with the worm 61 for rotation. At the same time, the solenoid 75 is energized and the plunger 71 is attracted to the yoke 77 to thereby move the shaft head portion 73*a* of the sliding shaft 73 backward and away from the end face of the driving shaft 63 and compress the disc spring 74 sandwiched between the spring seat 72 and the shaft head portion 73*a* to build up the spring force in the disc spring 74. At this time, although the reaction force is transmitted from the worm wheel 53 to the worm 61 as the clamping arm 51 rotates, the worm 61 is retained substantially in the initial position because it is elastically pushed and supported by the support spring 66 in a direction against the reaction force.

Figure 8:
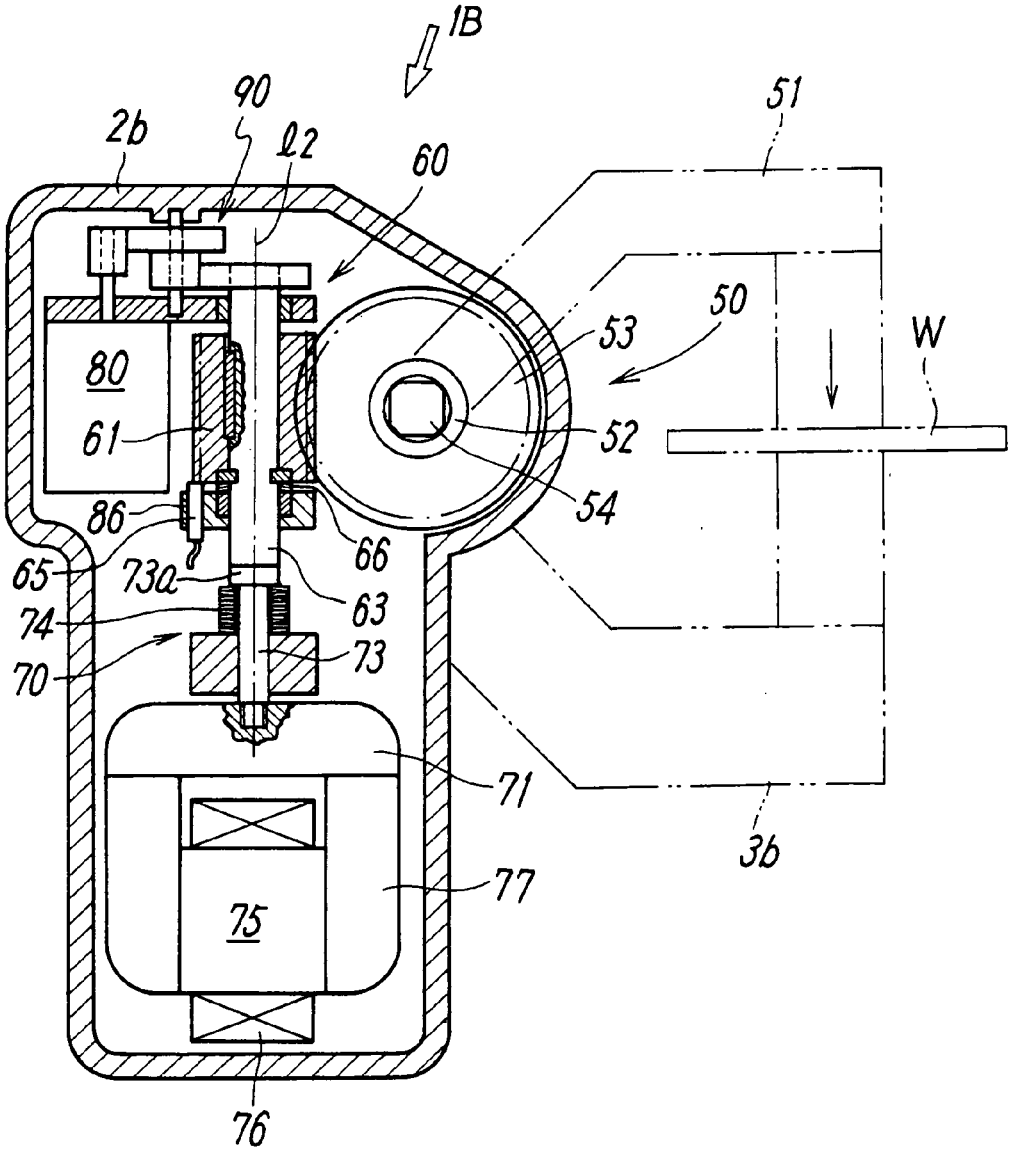
FIG. 8 is a sectional view of a state in which the clamping arm is in contact with a workpiece and a clamping force is applied to the clamping arm in the second embodiment.

Furthermore, when the rotated clamping arm 51 comes in contact with the workpiece W supported on the clamping member 3*b*, rotation of the worm wheel 53 is stopped by the contact and the reaction force caused by the contact is transmitted to the worm 61, as shown in FIG. 8. The worm 61 compresses the support spring 66 by the reaction force against the spring force of the support spring 66 while being driven for rotation by the electric motor 80 and is displaced to and stops in the clamping force transmitting position with the driving shaft 63.

At this time, the end face of the driving shaft 63 in the clamping force transmitting position is in contact with or close to the shaft head portion 73*a* of the sliding shaft 73 compressing the disc spring 74. Then, the contact sensor 65 senses that the end face of the worm 61 has approached the second bearing frame 86, i.e., that the worm 61 and the driving shaft 63 have been displaced to the clamping force transmitting position, de-energizes the solenoid 75, and stops the electric motor 80.

Then, when the solenoid 75 is de-energized, attraction of the plunger 71 to the yoke 77 is released and therefore the shaft head portion 73*a* presses the end face of the driving shaft 63 toward the initial position (in the opposite direction to the reaction force) by the spring force of the disc spring 74 compressed between the spring seat 72 and the shaft head portion 73*a*. As a result, the spring force is applied to the worm 61 as the axial force and acts on the worm wheel 53 engaged with the worm 61 as the pressing force in the direction of the tangent to the worm wheel 53 to thereby apply the clamping force to the clamping arm 51 in contact with the workpiece W.

In order to release clamping of the workpiece W, by starting and reversely rotating the electric motor 80, the clamping arm 51 is released from the clamping force, rotated reversely in such a direction as to move away from the clamping member 3*b*, and returned to the home position. On the other hand, the worm 61 is simultaneously returned to the initial position.

As described above, with the clamping device 1B according to the second embodiment of the invention, by detecting the contact of the clamping arm 11 with the workpiece W with the contact sensor 65, the clamping force applying mechanism 70 can be actuated to apply the clamping force to the clamping arm 11. Therefore, there is no need to carry out troublesome setting operation of a clamping position according to a size of the workpiece W and wear of respective components and operation efficiency can be further improved.

The invention claimed is:

1. A clamping device for clamping a workpiece between a clamping arm and an opposed clamping member by rotating the clamping arm supported for rotating on a body and applying a clamping force to the clamping arm, the device comprising:

a worm driving source, and a worm to be driven by the worm driving source, for rotation about an axis on the body;

a worm wheel provided to a periphery of a rotating shaft of the clamping arm and engaged with the worm; and a clamping force applying mechanism to be actuated in response to contact of the clamping arm with the workpiece supported by the clamping member to apply an axial force in a direction of the axis to the worm rotation of which has been stopped by the contact, wherein the clamping arm is rotated by driving of the worm for rotation and the axial force applied to the worm by the clamping force applying mechanism acts on the worm wheel as a pressing force in a direction of a tangent to the worm wheel to apply the clamping force to the clamping arm.

2. A clamping device according to claim 1, wherein the worm is provided for reciprocation between an initial position and a clamping force transmitting position on the axis and the clamping force applying mechanism applies the axial force toward the initial position to the worm which has been displaced from the initial position to the clamping force transmitting position by a reaction force from the worm wheel generated by a clamping operation of the clamping arm.

3. A clamping device according to claim 2, wherein the worm is elastically supported toward the initial position by a support spring disposed on the same axis and the worm is displaced from the initial position to the clamping force transmitting position against the support spring by the reaction force from the worm wheel generated by the clamping operation of the clamping arm.

4. A clamping device according to claim 3, wherein the support spring is a disc spring.

5. A clamping device according to claim 1, wherein the clamping force applying mechanism includes a spring member disposed on the axis and applies a spring force of the spring member to the worm as the axial force.

6. A clamping device according to claim 5, wherein the spring member is the disc spring, a flexure-spring force characteristic curve of the disc spring includes a region in which the spring force is substantially constant with respect to flexure variation, and the spring force in this region is applied to the worm as the axial force.

7. A clamping device according to claim 1, the device further comprising:

an arm rotating driving source for driving the worm for rotation;

a clamping force generating driving source provided to the clamping force applying mechanism independently of the arm rotating driving source so as to actuate the clamping force applying mechanism; and a contact sensor for detecting the contact of the clamping arm with the workpiece to output a signal for causing the clamping force generating driving source to operate, wherein the clamping force generating driving source is caused to operate by the output signal from the contact sensor to actuate the clamping force applying mechanism to thereby apply the axial force to the worm.

8. A clamping device according to claim 7, wherein the arm rotating driving source is an electric motor and the clamping force generating driving source is an electromagnetic driving device utilizing an electromagnetic attracting force.

9. A clamping device according to claim 7 and further comprising a driving shaft supported for rotation about the axis and for sliding in a reciprocating manner in the direction of the axis on the body and connected to the arm rotating driving source, wherein the worm is fixedly provided to a periphery of the driving shaft to be able to reciprocate between an initial position and a clamping force transmitting position on the axis and the clamping force applying mechanism applies the axial force toward the initial position to the worm which has been displaced from the initial position to the clamping force transmitting position by a reaction force from the worm wheel due to a clamping operation of the clamping arm.

10. A clamping device according to claim 9, wherein the clamping force applying mechanism includes the clamping force generating driving source, a spring member disposed on the axis, a plunger to be reciprocated in the direction of the axis by operation of the clamping force generating driving source, a sliding shaft passing through a center of the spring member and having one end fixed to the plunger and the other end formed with a shaft head portion with which one end of the spring member is in contact, and a spring seat with which the other end of the spring member is in contact and which supports the sliding shaft for sliding in the direction of the axis, the spring member being compressed between the shaft head portion and the spring seat by reciprocation of the plunger, wherein the clamping force generating driving source operates in response to the output signal from the contact sensor and, as a result, the shaft head portion presses the driving shaft in the direction of the axis with the spring force of the spring member compressed between the shaft head portion and the spring seat to thereby apply the spring force to the worm as the axial force.

11. A clamping device according to claim 10, wherein the spring member is a disc spring, a flexure-spring force characteristic curve of the disc spring includes a region in which the spring force is substantially constant with respect to flexure variation, and the spring force in this region is applied to the worm as the axial force.

12. A clamping device according to claim 9, wherein the worm is elastically supported toward the initial position by a support spring disposed on the same axis and the worm is displaced from the initial position to the clamping force transmitting position against the support spring by the reaction force from the worm wheel due to the contact of the clamping arm with the workpiece.

13. A clamping device according to claim 12, wherein the contact sensor is for sensing that the worm has been displaced to the clamping force transmitting position.

14. A clamping device according to claim 12, wherein the support spring is a disc spring.

* * * * *